US006430805B1

(12) United States Patent
Ekmekji et al.

(10) Patent No.: US 6,430,805 B1
(45) **Date of Patent: *Aug. 13, 2002**

(54) METHOD OF FABRICATING A TRUE-TIME-DELAY CONTINUOUS TRANSVERSE STUB ARRAY ANTENNA

(75) Inventors: Alec Ekmekji, Los Angeles; Douglas O. Klebe, Redondo Beach; Shahrokh Hashemi-Yeganeh, Rancho Palos Verdes; William W. Milroy, Torrance; Patrick J. Fitzgerald, Northridge; Gerald A. Cox, Playa Del Rey; Kenneth Nash, Moorpark, all of CA (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/187,673

(22) Filed: Nov. 6, 1998

(51) Int. Cl.[7] ..... H01P 11/00

(52) U.S. Cl. ..... 29/600; 29/DIG. 47; 343/772; 343/776; 343/853

(58) Field of Search ..... 29/600, 411, DIG. 47; 343/789, 772, 776, 853, 778

(56) References Cited

U.S. PATENT DOCUMENTS 3,925,883 A * 12/1975 Cavalear ..... 29/600
4,463,329 A * 7/1984 Suzuki ..... 29/600
4,623,894 A * 11/1986 Lee et al. ..... 343/776
4,878,060 A * 10/1989 Barbier et al. ..... 343/778
5,266,961 A * 11/1993 Milroy ..... 343/772
5,361,488 A * 11/1994 Higashiguchi et al. ..... 29/600
5,483,248 A 1/1996 Milroy
5,495,262 A * 2/1996 Klebe ..... 29/600
5,534,881 A * 7/1996 Young et al. ..... 343/776

FOREIGN PATENT DOCUMENTS

EP 0536522 4/1993

* cited by examiner

*Primary Examiner*—Peter Vo
*Assistant Examiner*—A. Dexter Tugbang
(74) *Attorney, Agent, or Firm*—Leonard A. Alkov; Glenn H. Lenzen, Jr.

(57) ABSTRACT

Methods of fabricating air-filed true-time-delay, continuous transverse stub array antenna. A plurality of extruded sections that are physically independent of one another are fabricated. The plurality of extruded sections are arranged in a predefined pattern defining the structure of the array antenna. Adjacent surfaces of the extruded sections form waveguides of the array antenna. The plurality of extruded sections are joined together at their respective ends to form the array antenna. The plurality of extruded sections may be joined using a plurality of end plates. The plurality of extruded sections and end plates may comprise metal or plastic. If the extruded sections are plastic, they are metallized 44 using a process such as vacuum deposition, electroless plating, or lamination during the extrusion process. The end plates are sealed to the extruded sections to form the array antenna structure.

9 Claims, 3 Drawing Sheets

METHOD OF FABRICATING A TRUE-TIME-DELAY CONTINUOUS TRANSVERSE STUB ARRAY ANTENNA

BACKGROUND

The present invention relates generally to array antennas and fabrication methods therefor, and more particularly, to low cost methods of fabricating a true-time-delay continuous transverse stub array antenna.

Previous true-time-delay, continuous transverse stub array antennas were made either by machining or molding microwave circuit features out of low-loss plastics, such as Rexolite® or polypropylene. The plastic was then metallized to form a dielectric-filled, overmoded waveguide or parallel-plate waveguide structure. Such antennas are disclosed in U.S. Pat. No. 5,266,961 entitled "Continuous Transverse Element Devices and Methods of Making Same", U.S. patent application Ser. No. 08/885,583, filed Jun. 30, 1997, entitled "Planar Antenna Radiating Structure Exhibiting Quasi-Scan/Frequency Independent Driving-Point Impedance", and U.S. patent application Ser. No. 08/884,837, filed Jun. 30, 1997, entitled "Compact, Ultrawideband, Matched E-Plane Power Divider".

Subsequently to the above inventions, U.S. patent application Ser. No. 08/884,837, filed Jun. 30, 1997, entitled "Methods of Fabricating True-Time-Delay Continuous Transverse Stub Array Antennas" describes an air-dielectric design fabricated from metal or metallized plastic sheets into which the desired microwave circuit features have been formed. The layers are then assembled and joined together using one of several available processes, such as inert gas furnace brazing or ultrasonic welding. However, a flawless bonding process is necessary to assure closure of the seams, as internal inspection and repair are usually not practical once the unit is assembled.

Air-dielectric has several significant advantages over solid-dielectric microwave structures, including lower losses and reduced susceptibility to nonuniformities in the microwave properties of the dielectric, such as inhomogeneity and anisotropy. RF energy does not propagate through the dielectric material. Thus, continuous transverse stub arrays may be fabricated using low-cost materials with excellent physical properties but poor microwave characteristics, such as acrylonitrile-butadiene-styrene (ABS), with metallic surfaces to mimic its conductive surfaces.

A prototype antenna was developed by the assignee of the present using the solid-dielectric approach. The prototype design operates satisfactorily over an extended band of 3.5 to 20.0 GHz. Dielectric parts of uniform cross section were made from Rexolite® 1422 using conventional machining techniques. The parts were bonded together with adhesive and then all outside surfaces except a line-feed input and the radiating aperture were metallized with a highly conductive silver paint.

The primary disadvantage of the solid-dielectric approach is the dielectric loss, which becomes increasingly significant at higher millimeter wave frequencies. Other disadvantages include variations in dielectric properties, such as inhomogeneity and anisotropy, the high cost of premium microwave dielectric materials, and to a lesser extent, the cost of fabrication, bonding and metallization of the dielectric parts. Air-filled designs also have problems, and in particular, microwave circuit features are internal to the waveguide structure and may be inaccessible for mechanical inspection after assembly. Thus the processes used to fabricate such antennas must insure accurate registration of parts, maintain close tolerances and provide continuous conducting surfaces across all seams.

Accordingly, it would be an advantage to have low cost methods of fabricating true-time-delay continuous transverse stub array antennas that improve upon previous methods.

SUMMARY OF THE INVENTION

The present invention provides for improved methods of fabricating air-filled, true-time-delay, continuous transverse stub array antennas comprising extruded sections to form desired microwave circuit features. End plates support the extrusions. The method of the present invention results in highly producible designs that can be manufactured in large quantities at very low cost.

An exemplary method comprise the following steps. A plurality of extruded sections that are physically independent of one another are fabricated. The plurality of extruded sections are arranged in a predefined pattern defining an array antenna structure, wherein adjacent surfaces form waveguides of the array antenna. The plurality of extruded sections are joined together at their respective ends to form the array antenna.

To join the extruded sections together, a plurality of end plates are typically fabricated and then the extruded sections are secured and specially located by the end plates. The plurality of extruded sections and end plates may comprise metal or plastic. If the extruded sections and end plates are plastic, they are metallized using a process such as vacuum deposition, electroless plating, or lamination during the extrusion process. The (metallized or metal) end plates are interconnected to the (metallized or metal) extruded sections to form the array antenna structure.

The present method may use either metal or plastic extrusions to form air-filled dielectric, parallel-plate waveguide structures. To obtain RF conductivity, plastic surfaces are metallized, using processes such as vacuum deposition, electroless plating, or by lamination during the extrusion process. The extrusions may be drawn as thin-walled tubes to minimize weight.

A major advantage of the present invention is that the parallel-plate waveguides formed by the extrusions are completely without seams. This is a major improvement over the layered construction previously cited in the Background section, where parting lines exist between adjacent layers.

The method of forming microwave structures from extruded sections may be generally employed to fabricate ultrawideband antenna feed and aperture architectures used in true-time-delay, continuous transverse stub array antennas. The fabrication processes are mature, and therefore yield designs that can be mass-produced at low-to-moderate cost. Such affordable, wideband antennas are of major importance to multifunctional military systems or high-production commercial products where a single wideband aperture can replace several narrowband antennas.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
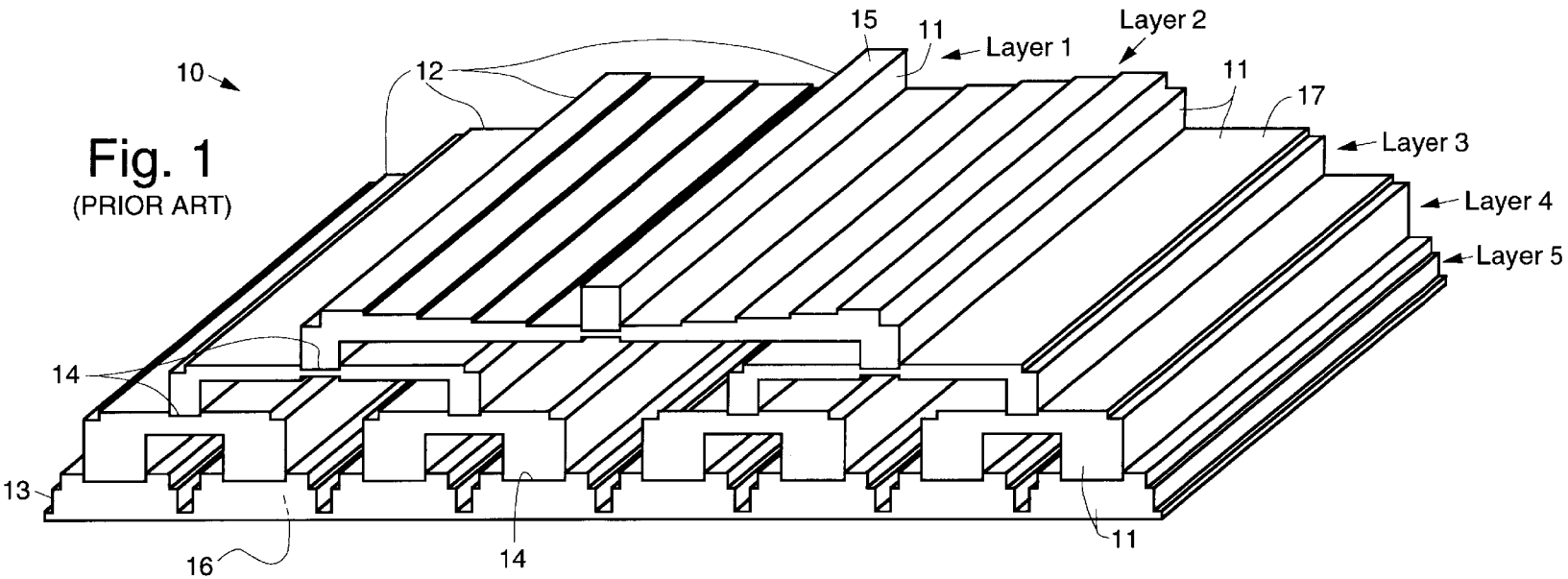
Fig. 1 (PRIOR ART)
FIG. 1 illustrates a conventional prototype antenna made from machined dielectric parts that are bonded together and metallized.

Referring to the drawing figures, FIG. 1 illustrates a conventional prototype true-time-delay, continuous transverse stub array antenna 10 developed by the assignee of the present using the solid-dielectric approach discussed in the Background section. The array antenna 10 is made from machined dielectric parts 11 that are bonded together and metallized. The array antenna 10 operates satisfactorily over an extended band of 3.5 to 20.0 GHz.

Figure 2:
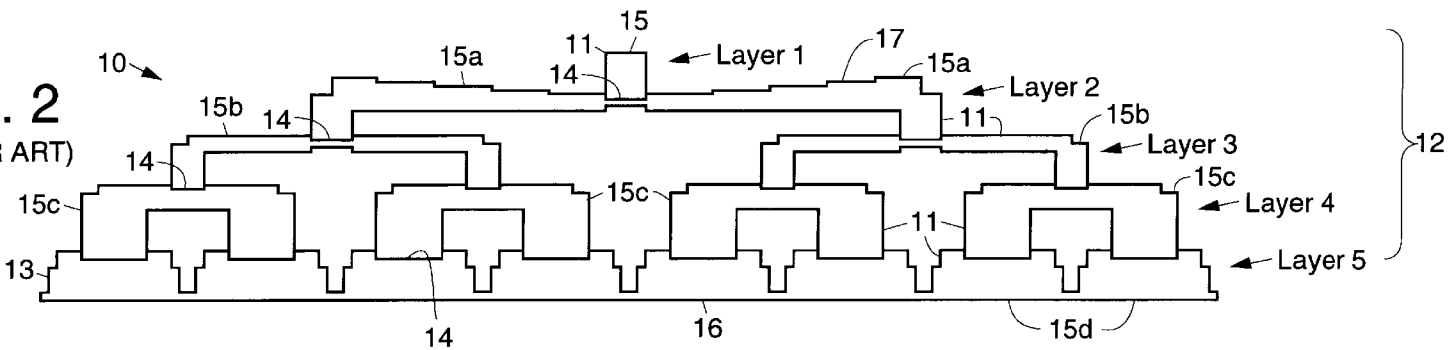
Fig. 2 (PRIOR ART)
FIG. 2 is a cross sectional side view of the conventional antenna of FIG. 1.

FIG. 2 shows how a corporate feed structure 12 or parallel-plate waveguide structure 12 (identified as layers 1 through 4) and aperture plate 13 (layer 5) were constructed. Dielectric parts 11 of uniform cross section were made from Rexolite® 1422 using conventional machining techniques. The parts 11 were bonded together with adhesive 14 and then all outside surfaces (except a line-feed input 15 along the top surface of layer 1 and the radiating aperture 16 on the underside of layer 5) were metallized with a layer 17 of highly conductive silver paint.

Converting the dielectric-filled design of FIG. 1 to an air-dielectric version conceptually requires that the volume occupied by solid dielectric material be replaced by air, while surrounding voids are filled with a solid electrically conductive material to delineate walls of a parallel-plate waveguide. Where weight reduction is desirable, the voids can be partially filled, as long as the required degree of structural integrity and shape is satisfied. The solid segments of material in FIG. 3 cannot be interconnected, except at the ends of the array antenna, without intruding into the parallel-plate waveguide region.

FIG. 2 shows a cross sectional view (not to scale) of the dielectric-filled array antenna 10 of FIG. 1. The antenna 10 includes the line-feed input 15 (layer 1), a first two-way power splitter 15*a* (layer 2), another pair of two-way power splitters 15*b* (layer 3), four more two-way power splitters 15*c* (layer 4) and eight continuous transverse stub radiators 15*d* (layer 5) fabricated as a single layer for structural integrity. The various pieces are grooved to make the assembly self-jigging for bonding. Because of the cantilevered construction of the two-way power splitters of the 15*c* antenna 10, only moderate pressure can be applied during bonding to assure that mating surfaces are joined without introducing air gaps. Because they would lie within the parallel-plate waveguide region, any gaps could seriously disrupt normal waveguide propagation, especially if intrusion by conductive material occurs.

The primary disadvantage of the dielectric-filled approach is its greater dielectric loss, which becomes increasingly significant at higher millimeter wave frequencies. Other disadvantages include variations in dielectric properties, such as inhomogeneity and anisotropy, the high cost of premium microwave dielectric materials, and to a lesser extent, the cost of fabrication, bonding and metallization of the dielectric parts. Air-dielectric designs also have problems, and in particular, microwave circuit features are internal to the waveguide structure and may be inaccessible for mechanical inspection after assembly. Thus the processes used to fabricate such antennas must insure accurate registration of parts, maintain close tolerances and provide continuous conducting surfaces across seams in waveguide walls.

The fabrication processes that are used must also be capable of holding close tolerances, assure accurate registration of the parts, and provide continuous conducting surfaces across seams where high RF current densities might exist. The method of the present invention for manufacturing air-dielectric, true-time-delay, continuous transverse stub array antennas addresses the aforementioned problems.

Figure 3:
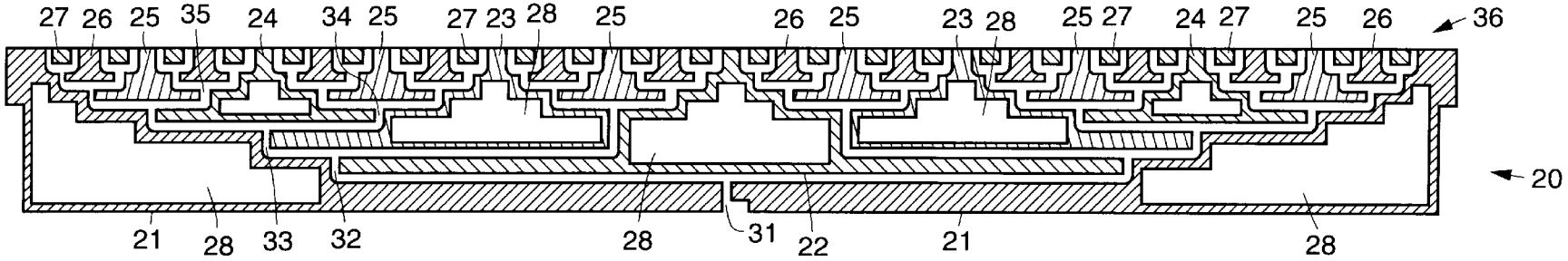
FIG. 3 is a cross sectional view of an air-dielectric true-time-delay, continuous transverse stub array antenna made using a fabrication method in accordance with the principles of the present invention.
Figure 4:
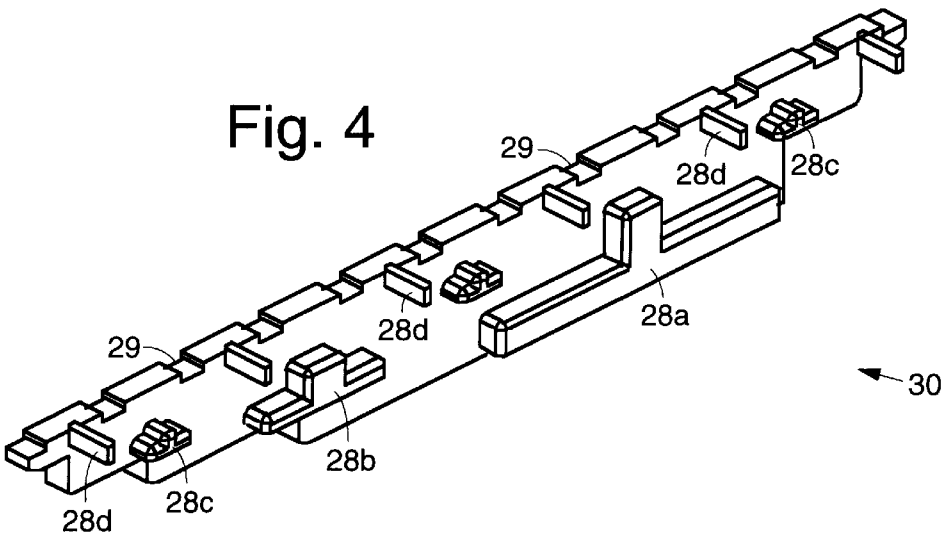
FIG. 4 illustrates a portion of an end plate and corresponding features for aligning and captivating extrusions of the antenna shown in FIG. 2.

Referring now to FIG. 3, it is a cross sectional view of an air-dielectric true-time-delay, continuous transverse stub array antenna 20 made using a fabrication method 40 (FIG. 5) in accordance with the principles of the present invention. Converting the solid-dielectric design of FIG. 1 to an air-dielectric version conceptually requires that the volumes occupied respectively by solid dielectric material and air be interchanged, as shown in the cross section of FIG. 3. The walls of the microwave structure are formed by the conductive surfaces of a plurality of extruded sections 21, 22, 23, 24, 25, 26, 27 or extrusions 21–27 that are physically independent of one another, except at their respective ends when assembled. The plurality of extrusions 21–27 are accurately positioned and captivated by end plates 30. A portion of one of the end plates 30 is shown in FIG. 4. Most of the extrusions 21–27 are made with cavities 28 so that they are hollow, not only for weight reduction, but also as a simple means to attach to tabs extending from the end plates 30.

As is shown in FIG. 3, waveguide channels 31–34 in the air-filled design correspond to waveguide channels defined by layers 1 through 4 in the dielectric-filled design of FIG. 1. Waveguide channels 35, 35*a* in FIG. 3 increase the array to a 48-element design. The conventional antenna array 10 has an aperture plate 16 shown in FIG. 1 and the present antenna array 20 has an aperture plate 36 shown in FIG. 3. Seven types of extrusions 21–27 or extrusions 21–27 shown in FIG. 3, are attached to tabs 28*a*, 28*b*, 28*c*, 28*d* and positioned in grooves 29 of the end plate 30 (shown upside-down), respectively. Another fabrication technique is to load the extrusions 21–27 into an alignment fixture and then injection mold plastic to form the end plates 30. Thus, the molded end plates 30 locate and captivate the extrusions 21–27.

The features of the air-filled true-time-delay, continuous transverse stub array antenna fabricated using extruded metal or plastic members in accordance with the present invention are as follows. Air replaces solid dielectric as a propagating medium. The parallel-plate waveguide structure is formed by noncontacting parts, and forms an overmoded parallel-plate waveguide structure. The array antenna may be formed using extruded or injection molded parts. Features of matching structures may be formed by extrusion. The extrusions may be made hollow to reduce weight and aid in assembly. Matching structures contain orthogonal sets of walls. Extruded sections may be molded into end plates. The array antenna has an open construction. Microwave features are on the outside of the extrusions and thus may be inspected.

The benefits of the air-dielectric true-time-delay, continuous transverse stub array antenna fabricated using extruded metal or plastic members are as follows. There is lower RF loss, no inhomogeneity or anisotropy. There are no seams within the aperture area, which eliminates discontinuities and RF leakage. There is no RF closure required at ends. The design is configured for high-volume, low-cost production. There is a reduction in parts count and assembly time. Alignment and captivation is easy and weight is reduced. Cross members give rigidity to the structure. There is reduced assembly time and an air-tight seal. The structures are easy to plate or passivate. The structures are accessible for inspection and repair. The aperture structures are self-jigging in the end plates 30.

Figure 5:
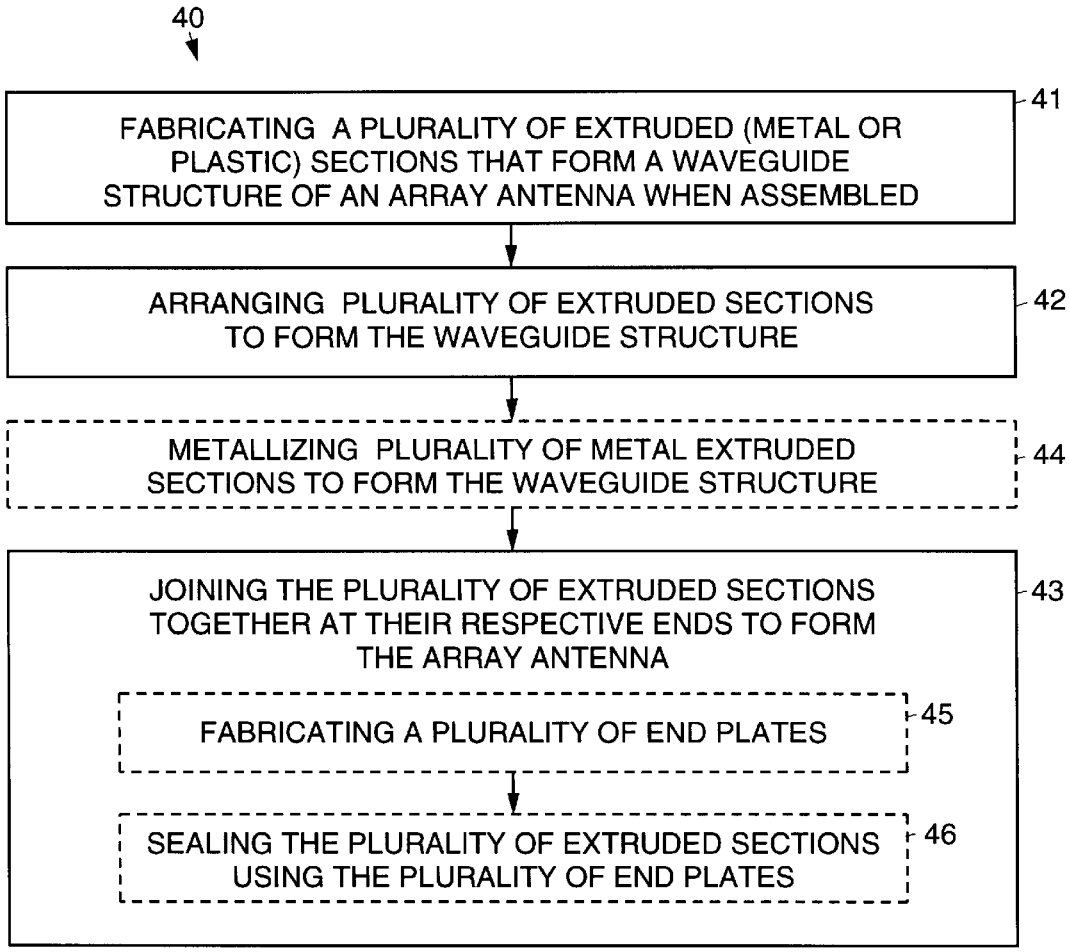
FIG. 5 is a flow diagram illustrating exemplary methods in accordance with the principles of the present invention of fabricating air-dielectric true-time-delay, continuous transverse stub array antennas.

FIG. 5 is a flow diagram illustrating exemplary methods 40 of fabricating air-dielectric true-time-delay, continuous transverse stub array antennas 20 in accordance with the principles of the present invention. The exemplary methods 40 comprise the following steps.

A plurality of extrusions 21–27 that are physically independent of one another are fabricated. The plurality of extrusions 21–27 are arranged in a predefined pattern defining an array antenna structure, wherein adjacent surfaces form waveguides of the array antenna 20. The plurality of extrusions 21–27 are joined 43 or sealed 43 together at their respective ends to form the array antenna 20.

To join 43 or seal 43 the extrusions 21–27 together, a plurality of end plates 30 may be fabricated 45 and then the extrusions 21–27 are secured 46 by the end plates 30. The plurality of extrusions 21–27 and end plates 30 may comprise metal or plastic. If the extrusions 21–27 and end plates 30 are plastic, they are metallized 44 using a process such as vacuum deposition, electroless plating, or lamination during the extrusion process. The (metallized or metal) end plates 30 and extrusions 21–27 are joined 46 to form the array antenna structure.

The present continuous transverse stub array fabrication methods 40 may use either metal or plastic components to form air-dielectric, parallel-plate waveguide structures. To obtain good RF conductivity, plastic surfaces are metallized, using processes such as vacuum deposition, electroless plating, or by lamination during the extrusion process. The extrusions 21–27 may be drawn as thin-walled tubes to minimize weight.

The extrusions 21–27 and end plates 30 may be made of plastic, such as aerylonitrile-butadiene-styrene (ABS) or polypropylene, or metal, such as an aluminum or copper alloy. If the extrusions 21–27 and end plates 30 are made from plastic, then the surfaces that form the parallel-plate waveguide structure 12 are metallized 44 for good electrical conductivity across the operating frequency band. Standard microwave practice is to make the metallization at least three skin depths "δ" thick, with five skin depths "δ" preferred. Several options exist for metallizing 44 the plastic components. These include using conductive silver paint, vacuum deposition, lamination and electroless plating. Any of these processes can be used to metallize 44 the parallel-plate waveguide surfaces before assembly.

Silver paint, which may be applied either by brush or spray gun, is usually reserved for breadboard designs or touching up areas that might have been missed by other metallization techniques.

Vacuum deposition processes can be divided into two general categories: evaporation of metal atoms from a heated source in a high vacuum; and deposition of metal atoms from an electrode by the ion plasma of an inert gas at reduced pressure. Evaporation is a line-of-sight operation, while plasma deposition gives limited coverage around corners due to random scattering from collision of the particles. Either process is suitable for metallizing 44 the unassembled layers; however, neither approach is viable once the assembly has been bonded.

Metal laminated plastic sheets can be shaped using a process known as blow molding. Another technique is to place a metal-foil preform into a mold and inject hot plastic under pressure to form a laminated part. If the foil is thin and the mold is designed to eliminate sharp edges and corners, the process yields high definition parts.

Nonconductive materials such as ABS may be plated directly with an electroless process. A sequence of chemical baths prepares the surfaces and then deposits a stable layer of metal, usually copper or nickel. Electroless copper is limited in practice to a maximum thickness of about 100 microinches (2.54 microns), after which the highly active plating solution starts to react with fixtures and contaminates the bath. As 100 microinches represents only about four skin depths at 10 GHz, a thicker layer of metal is required to realize reasonably low conductor losses at higher operating frequencies. This is most often done by "plating up" the electroless layer using conventional electroplating processes. Electroplating is not practical in most arrangements of bonded assemblies for several reasons. First, a plating electrode is required that extends throughout the narrow parallel-plate waveguide channels, where inaccessible blind passages may exist. Second, the electric field is greatly enhanced at sharp corners causing a local buildup of metal, while diminished fields at concave surfaces will result in a sparseness of metal.

Any of the processes described above can be used to metallize 32 the unassembled plastic extrusions 21–27. However, the best choice depends on particulars of the application.

A second method 40 of antenna fabrication uses machined aluminum extrusions 21–27 and end plates 30, for example, that are brazed together. This approach is better suited for applications that can afford higher manufacturing costs in order to obtain close-tolerance microwave features and a more rugged mechanical design. Furnace brazing is usually reserved for aluminum alloys, which normally cannot be joined by lower temperature methods. Copper alloys, on the other hand, are most often joined either using a low-temperature lead-based solder, or are torch brazed using a high-temperature silver solder.

Thus, methods of fabrication a true-time-delay continuous transverse stub array antenna have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A method of fabricating an air-dielectric true-time-delay continuous transverse stub array antenna, said method comprising the steps of:

fabricating a plurality of extruded sections that form an air-dielectric parallel-plate waveguide structure of the air-dielectric continuous transverse stub array antenna when assembled;

arranging the plurality of extruded sections to form the air-dielectric parallel-plate waveguide structure; and joining the plurality of extruded sections together at their respective lateral ends to form the air-dielectric continuous transverse stub array antenna.

2. The method of claim 1 wherein the plurality of extruded sections comprise plastic.

3. The method of claim 2 wherein the plastic extruded sections comprise aerylonitrile-butadiene-styrene.

4. The method of claim 2 wherein the plastic extruded sections comprise polypropylene.

5. The method of claim 1, which further comprises the step of metallizing, the individual extruded sections prior to arranging.

6. The method of claim 5 wherein the metallizing step comprises electrolessly plating surfaces to be metallized.

7. The method of claim 1 wherein the step of joining the plurality of extruded sections together comprises the steps of:

fabricating a plurality of end plates; and sealing the plurality of extruded sections to the plurality of end plates to form the air-dielectric continuous transverse stub array antenna.

8. A method of fabricating an air-dielectric true-time-delay continuous transverse stub array antenna, said method comprising the steps of:

fabricating a plurality of extruded sections that form an air-dielectric parallel-plate waveguide structure of the air-dielectric continuous transverse stub array antenna when assembled;

arranging the plurality of extruded sections to form the air-dielectric parallel-plate waveguide structure; and joining the plurality of extruded sections together at their respective lateral ends to form the air-dielectric parallel-plate continuous transverse stub array antenna such that air space exists between adjacent surfaces of the extruded sections that couples energy through the antenna.

9. The method of claim 8 wherein the step of joining the plurality of extruded sections together comprises the steps of:

fabricating a plurality of end plates; and sealing the plurality of extruded sections to the plurality of end plates to form the air-dielectric continuous transverse stub array antenna.

* * * * *

UNITED STATES PATENT AND TRADEMARK OFFICE

CERTIFICATE OF CORRECTION

PATENT NO. : 6,430,805 B1 
DATED : August 13, 2002
INVENTOR(S) : Alec Ekmekji, Douglas O. Klebe, Kenneth Nash, Shahrokh Hashemi-Yeganeh, Edward L. Robertson, William W. Milroy, Patrick J. Fitzgerald and Gerald A. Cox It is certified that error appears in the above-identified patent and that said Letters Patent is hereby corrected as shown below:

Title page,
Inventors, the name -- Edward L. Robertson -- should be added after the name "Shahrokh Hashemi-Yeganeh"

Signed and Sealed this

Fifth Day of November, 2002

*Attest:*

*Attesting Officer*

JAMES E. ROGAN
*Director of the United States Patent and Trademark Office*